US006866598B2

(12) United States Patent
Giannetti et al.

(10) Patent No.: US 6,866,598 B2
(45) Date of Patent: Mar. 15, 2005

(54) BALL BAT WITH A STRAIN ENERGY OPTIMIZED BARREL

(75) Inventors: William B. Giannetti, Woodland Hills, CA (US); Dewey Chauvin, Simi, CA (US); Hsing-Yen Chuang, Studio City, CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 10/712,251

(22) Filed: Nov. 13, 2003

(65) Prior Publication Data

US 2004/0132563 A1 Jul. 8, 2004

Related U.S. Application Data

(63) Continuation-in-part of application No. 10/336,130, filed on Jan. 3, 2003, now Pat. No. 6,764,419.

(51) Int. Cl.[7] ..... A63B 59/06
(52) U.S. Cl. ..... 473/567
(58) Field of Search ..... 473/564–568, 473/519, 530, 457

(56) References Cited

U.S. PATENT DOCUMENTS

| | | | | | |
|---|---|---|---|---|---|
| 1,611,858 | A | | 12/1926 | Middlekauff | |
| 4,931,247 | A | * | 6/1990 | Yeh | 264/258 |
| 5,301,940 | A | | 4/1994 | Seki et al. | |
| 5,364,095 | A | | 11/1994 | Easton et al. | |
| 5,395,108 | A | * | 3/1995 | Souders et al. | 473/567 |
| 5,415,398 | A | | 5/1995 | Eggiman | |
| 5,511,777 | A | | 4/1996 | McNeely | |
| 5,624,115 | A | | 4/1997 | Baum | |
| 5,676,610 | A | | 10/1997 | Bhatt et al. | |
| 5,899,823 | A | | 5/1999 | Eggiman | |
| 6,042,493 | A | * | 3/2000 | Chauvin et al. | 473/566 |
| 6,053,828 | A | | 4/2000 | Pitsenberger | |
| 6,344,007 | B1 | * | 2/2002 | Feeney et al. | 473/567 |
| 6,352,485 | B1 | | 3/2002 | Philpot et al. | |
| 6,383,101 | B2 | | 5/2002 | Eggiman et al. | |
| 6,425,836 | B1 | * | 7/2002 | Misono et al. | 473/567 |
| 6,663,517 | B2 | * | 12/2003 | Buiatti et al. | 473/566 |
| 6,723,012 | B1 | * | 4/2004 | Sutherland | 473/567 |
| 6,733,404 | B2 | * | 5/2004 | Fritzke et al. | 473/566 |

OTHER PUBLICATIONS

U.S. Appl. No. 10/167,094, filed Oct. 17, 2002, Buiatti et al.

* cited by examiner

*Primary Examiner*—Mark S. Graham
(74) *Attorney, Agent, or Firm*—Perkins Coie LLP

(57) ABSTRACT

A ball bat includes a barrel having a substantially cylindrical outer wall including a first material located radially outwardly from a neutral axis of the outer wall, and a second material located radially inwardly from the neutral axis of the outer wall. The barrel further includes a substantially cylindrical inner wall located within the outer wall and including a third material located radially outwardly from a neutral axis of the inner wall, and a fourth material located radially inwardly from the neutral axis of the inner wall. The first and third materials each have a specific energy storage in compression of at least 2000 psi, and the second and fourth materials each have a tensile modulus of at least 18 million psi. The ball bat exhibits excellent performance and durability characteristics.

17 Claims, 3 Drawing Sheets

Table 1. Specific Energy Storage of Common Composite Structural Materials

| Property/Material | | | | | | |
|---|---|---|---|---|---|---|
| | Graphite | Eglass | Sglass | Kevlar | Boron | T300 |
| | Epoxy | Epoxy | Epoxy | Epoxy | Epoxy | Epoxy |
| | | | | | | Fabric |
| **Stiffness** | | | | | | |
| Ex (psi) | 2.00E+07 | 5.60E+06 | 6.91E+06 | 1.10E+07 | 2.96E+07 | 1.07E+07 |
| | | | | | | |
| **Strength** | | | | | | |
| Long Tens. (psi) | 2.10E+05 | 1.54E+05 | 2.46E+05 | 2.03E+05 | 1.83E+05 | 7.20E+04 |
| Long Comp. (psi) | 2.10E+05 | 8.85E+04 | 1.68E+05 | 3.41E+04 | 3.63E+05 | 5.10E+04 |
| | | | | | | |
| **Density** | | | | | | |
| ρ | 1.60 | 1.80 | 1.83 | 1.46 | 2.00 | 1.50 |
| | | | | | | |
| **Specific Energy Storage** | | | | | | |
| Tensile (psi) | 1.38E+03 | 2.35E+03 | 4.79E+03 | 2.56E+03 | 5.65E+02 | 3.24E+02 |
| Compression (psi) | 1.38E+03 | 7.77E+02 | 2.23E+03 | 7.22E+01 | 2.22E+03 | 1.62E+02 |

Fig. 5

BALL BAT WITH A STRAIN ENERGY OPTIMIZED BARREL

This application is a Continuation-In-Part of U.S. patent application Ser. No. 10/336,130, filed Jan. 3, 2003, which issued as U.S. Pat. No. 6,764,419 on Jul. 20, 2004, and which is incorporated herein by reference.

BACKGROUND OF INVENTION

Baseball and softball bat manufacturers are continually attempting to develop ball bats that exhibit increased durability and improved performance characteristics. Ball bats typically include a handle, a barrel, and a tapered section joining the handle to the barrel. The outer shell of these bats is generally formed from aluminum or another suitable metal, and/or one or more composite materials.

Barrel construction is particularly important in modern bat design. Barrels having a single-wall construction, and more recently, a multi-wall construction, have been developed. Modern ball bats typically include a hollow interior, such that the bats are relatively lightweight and allow a ball player to generate substantial "bat speed" or "swing speed."

Single-wall bats generally include a single tubular spring in the barrel section. Multi-wall barrels typically include two or more tubular springs, or similar structures, that may be of the same or different material composition, in the barrel section. The tubular springs in these multi-wall bats are typically either in contact with one another, such that they form friction joints, are bonded to one another with weld or bonding adhesive, or are separated from one another forming frictionless joints. If the tubular springs are bonded using a structural adhesive, or other structural bonding material, the barrel is essentially a single-wall construction. U.S. Pat. No. 5,364,095, the disclosure of which is herein incorporated by reference, describes a variety of bats having multi-walled barrel constructions.

It is generally desirable to have a bat barrel that is durable, while also exhibiting optimal performance characteristics. Hollow bats typically exhibit a phenomenon known as the "trampoline effect," which essentially refers to the rebound velocity of a ball leaving the bat barrel as a result of flexing of the barrel wall(s). Thus, it is desirable to construct a ball bat having a high "trampoline effect," so that the bat may provide a high rebound velocity to a pitched ball upon contact.

The "trampoline effect" is a direct result of the compression and resulting strain recovery of the barrel. During this process of barrel compression and decompression, energy is transferred to the ball resulting in an effective coefficient of restitution (COR) of the barrel, which is the ratio of the post impact ball velocity to the incident ball velocity (COR= Vpost impact/Vincident). In other words, the "trampoline effect" of the bat improves as the COR of the bat barrel increases.

Multi-walled bats were developed in an effort to increase the amount of acceptable barrel deflection beyond that which is possible in typical single-wall designs. These multi-walled constructions generally provide added barrel deflection, without increasing stresses beyond the material limits of the barrel materials. Accordingly, multi-wall barrels are typically more efficient at transferring energy back to the ball, and the more flexible property of the multi-wall barrel reduces undesirable deflection and deformation in the ball, which is typically made of highly inefficient material.

Additionally, a multi-wall bat differs from a single-wall bat because there is no shear energy transfer through the interface shear control zone(s) ("ISCZ"), i.e., the region(s) between the barrel walls. As a result of strain energy equilibrium, this shear energy, which creates shear deformation in a single-wall barrel, is converted to bending energy in a multi-wall barrel. And since bending deformation is more efficient in transferring energy than is shear deformation, the walls of a multi-wall bat typically exhibit a lower strain energy loss than a single wall design. Thus, multi-wall barrels are generally preferred over single-wall designs for producing efficient bat-ball collision dynamics, or a better "trampoline effect."

In a single wall bat, a single neutral axis, which is defined as the centroid axis about which all deformation occurs, is present for both radial and axial deformations. The shear stress in the barrel wall is at a maximum, and the bending stress is zero, along this neutral axis. In a multi-wall bat, an additional independent neutral axis results from each ISCZ present, i.e., each wall of a multi-wall barrel includes an independent neutral axis. As the bat barrel is impacted, each barrel wall deforms such that the highest compressive stresses occur radially above (i.e., on the impact side of) the neutral axis, while the highest tensile stresses occur radially below (i.e., on the non-impact side of) the neutral axis.

In general, as the wall thickness or barrel stiffness is increased in a bat barrel, the COR decreases. It is important to maintain a sufficient wall thickness, however, because the durability of the ball bat typically decreases if the wall(s) are too thin. If the barrel wall(s) are too thin, the barrel may be subject to denting, in the case of metal bats, or to progressive material failure, in the case of composite bats. As a result, the performance and lifetime of the bat may be reduced if the barrel wall(s) are not thick enough.

The use of composite materials has become increasingly popular in modern barrel design. The impact and fracture behavior of composite materials is very complex. Structural composite materials do not undergo plastic deformation, like metals, but undergo a series of local fractures resulting in a highly complicated redistribution of stress. When these resultant stresses exceed a predefined limit, ultimate breakdown of the structure occurs. It is very difficult, if not impossible, to accurately predict the initiation and progression of failure in these complex structures based on the behavior of unidirectional laminates in the structure. There is a way, however, to predict the amount of elastic energy that can be stored per unit mass for a particular mode of stressing. This is defined as the specific energy storage, which is the amount of energy that can be stored in a material before the material fails.

The specific energy storage capability of a material for tensile or compression loading is defined as follows:

$$\epsilon=\sigma_{lt}^2/E_{lt}\rho$$

where $\epsilon$=specific energy storage $\sigma_{lt}$=ultimate longitudinal tensile (or compressive) strength $E_{lt}$=Young's longitudinal tensile (or compressive) modulus $\rho$=density Thus, a material with high tensile/compressive strength and low modulus and density will have good energy storage properties.

Elastic materials undergo deformation (i.e., spring like behavior) when influenced by the application of a force. Under conditions such as impact loading, when large forces are applied over short periods of time, kinetic energy is transformed at the elastic material interface into potential energy in the form of deformation. As a result of entropy, some irreversible losses, in the form of noise and heat, occur during this energy transfer process.

When the available kinetic energy of impact is transformed into deformation in the elastic material, the elastic material releases this stored energy in the form of kinetic energy back to the impacting body (i.e., the ball), if it is in contact, and/or the stored energy is dissipated within the elastic material, if the impacting body is not in contact with the elastic material. As a result of irreversible energy losses, the elastic material eventually returns to its original stress-free condition.

The total conservation of energy equation for a bat-ball collision is as follows:

$$U_{K1b}+U_{K2b}=U_{K1a}+U_{K2a}+U_{H}+U_{BM}+U_{MS}$$

where, $U_{K1b}$=ball kinetic energy before impact $U_{K2b}$=bat kinetic energy before impact $U_{K1a}$=ball kinetic energy after impact $U_{K2a}$=bat kinetic energy after impact $U_{H}$=local bat and ball strain energy loss $U_{BM}$=energy loss associated with bat beam modes $U_{MS}$=energy losses associated with heat and noise (Mustone, Timothy J., Sherwood, James, "*Using LS-DYNA to Develop a Baseball Bat Performance and Design Tool*", 6th International LS-DYNA Users Conference, Detroit, Mich., Apr. 9–10, 2000).

Control and optimization of these losses is important to the design of high performance durable ball bats, particularly the losses associated with local bat and ball strain energy. The other losses, such as those associated with heat and noise, although a significant component in the overall equilibrium equation, are minor in comparison to the strain energy losses. Thus, to design a high performance durable bat, it is desirable to minimize strain energy losses in the barrel of the ball bat.

SUMMARY OF THE INVENTION

The invention is directed to a ball bat that exhibits minimal strain energy losses associated with bat-ball collisions by employing one or more integral interface shear control zones in the bat barrel, and/or by the selection and placement of specific composite materials with respect to the neutral axes in the barrel walls.

In a first aspect, a bat barrel includes a substantially cylindrical outer wall including a first material located radially outwardly from the neutral axis of the outer wall, and a second material located radially inwardly from the neutral axis of the outer wall. The barrel further includes a substantially cylindrical inner wall separated from the outer wall by an interface shear control zone, and includes a third material located radially outwardly from the neutral axis of the inner wall, and a fourth material located radially inwardly from the neutral axis of the inner wall. The first and third materials each have a specific energy storage in compression of at least 2000 psi, and the second and fourth materials each have a tensile modulus of at least 18 million psi.

In another aspect, the first and third materials each comprise a structural glass-reinforced epoxy resin.

In another aspect, the second and fourth materials each comprise a graphite-reinforced epoxy resin.

In another aspect, at least one of the first, second, third, and fourth materials comprises a boron-reinforced epoxy resin.

In another aspect, a layer of bond inhibiting material separates the outer wall from the inner wall. In a related aspect, the outer wall, the inner wall, and the layer of bond inhibiting material all terminate or blend together at at least one end of the barrel.

In another aspect, the bat barrel includes a substantially cylindrical outer wall and a substantially cylindrical inner wall located within the outer wall. The outer wall and the inner wall blend together at at least one end of the barrel.

In another aspect, the bat barrel includes a substantially cylindrical wall including a first material located radially outwardly from a neutral axis of the wall, and a second material located radially inwardly from the neutral axis of the wall. The first material has a specific energy storage in compression of at least 2000 psi, and the second material has a tensile modulus of at least 18 million psi.

Further embodiments, including modifications, variations, and enhancements of the invention, will become apparent. The invention resides as well in subcombinations of the features shown and described.

BRIEF DESCRIPTION OF THE DRAWINGS

In the drawings, wherein the same reference number indicates the same element throughout the several views:

FIG. 5 is a table showing various properties of common composite structural materials.

DETAILED DESCRIPTION OF THE DRAWINGS

Figure 1:
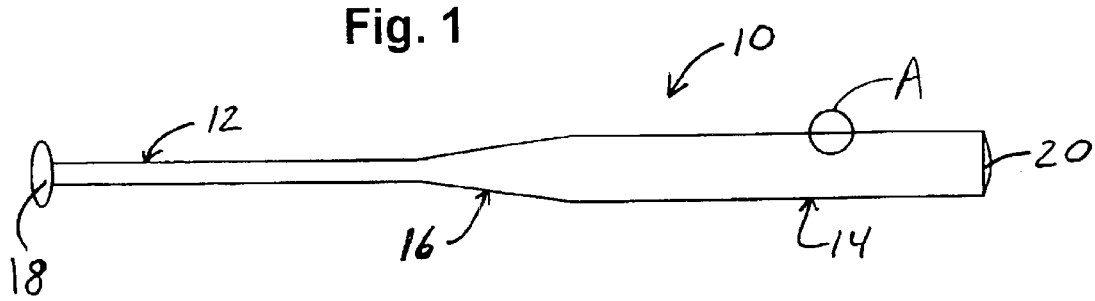
FIG. 1 is a perspective view of a ball bat.
Figure 2:
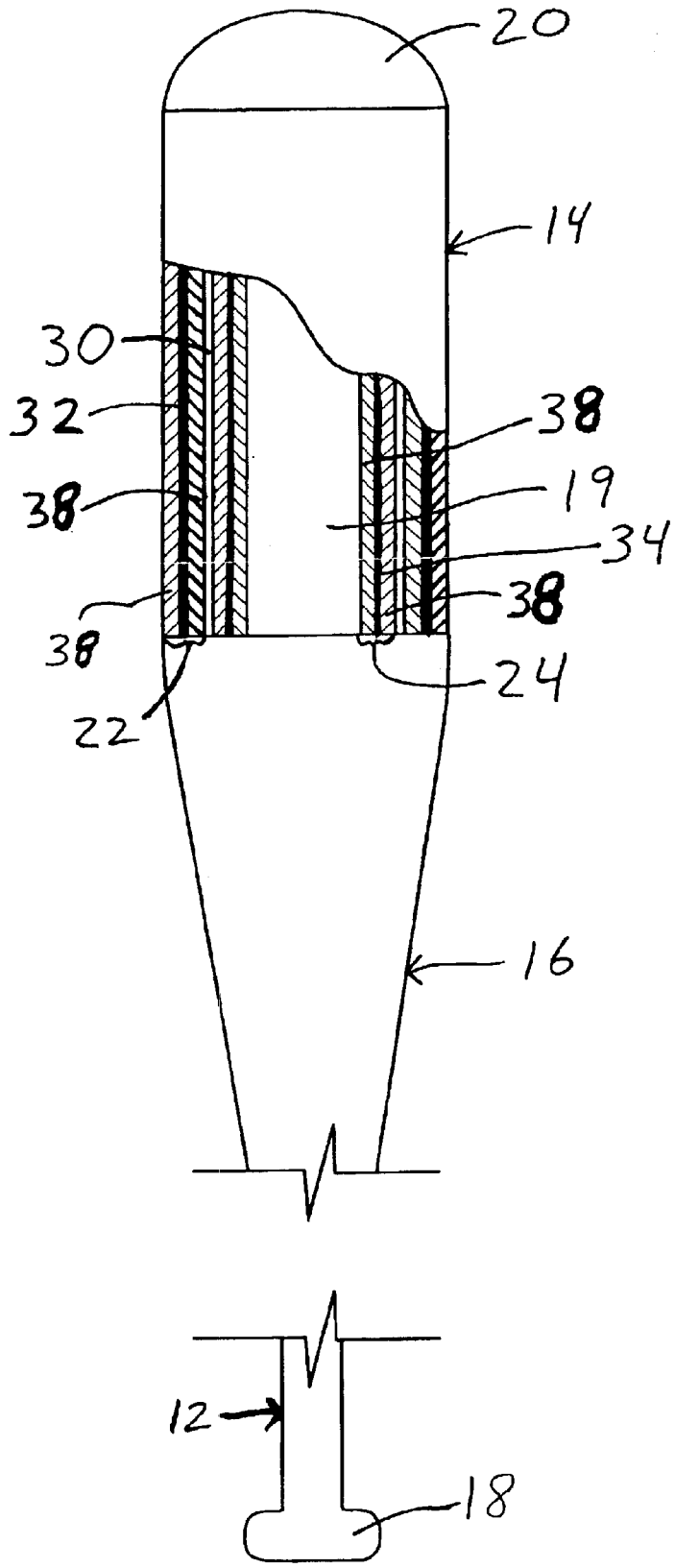
FIG. 2 is a perspective partially cutaway view of the ball bat illustrated in FIG. 1.

Turning now in detail to the drawings, as shown in FIGS. 1 and 2, a baseball or softball bat 10, hereinafter collectively referred to as a "ball bat" or "bat," includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior 19 of the bat 10 is preferably hollow, which allows the bat 10 to be relatively lightweight so that ball players may generate substantial bat speed when swinging the bat 10.

The ball bat 10 preferably has an overall length of 20 to 40 inches, more preferably 26 to 34 inches. The overall barrel diameter is preferably 2.0 to 3.0 inches, more preferably 2.25 to 2.75 inches. Typical bats have diameters of 2.25, 2.69, or 2.75 inches. Bats having various combinations of these overall lengths and barrel diameters are contemplated herein. The specific preferred combination of bat dimensions is generally dictated by the user of the bat 10, and may vary greatly between users.

The present invention is primarily directed to the ball striking area of the bat 10, which typically extends throughout the length of the barrel 14, and which may extend partially into the tapered section 16 of the bat 10. For ease of description, this striking area will generally be referred to as the "barrel" throughout the remainder of the description.

As illustrated in FIG. 2, the barrel 14 is made up of one or more substantially cylindrical layers. The actual shape of each barrel layer may vary according to the desired shape of the overall barrel structure. Accordingly, "substantially cylindrical" will be used herein to describe cylindrical barrel layers, as well as other similar barrel shapes. The barrel 14 preferably includes an outer barrel wall 22 and an inner barrel wall 24 located within the outer barrel wall 22, each preferably made up of one or more plies 38 of a composite material. Alternatively, the barrel 14 may include only a single wall, or may include three or more walls. The barrel wall(s) may additionally or alternatively be made of one or more metallic materials, such as aluminum or titanium.

A bond inhibiting layer 30, or a disbanding layer, preferably separates the outer barrel wall 22 from the inner barrel wall 24. The bond inhibiting layer 30 acts as an interlaminar shear control zone ("ISCZ") between the outer wall 22 and the inner wall 24. Accordingly, the bond inhibiting layer 30 prevents shear stresses from passing between the outer wall 22 and the inner wall 24, and also prevents the outer wall 22 from bonding to the inner wall 24 during curing of the bat 10, and throughout the life of the bat 10. Because the bond inhibiting layer 30 acts as an ISCZ, the outer barrel wall 22 has a first neutral axis 32, and the inner barrel 24 wall has a second neutral axis 34, as described above.

The bond-inhibiting layer 30 preferably has a radial thickness of approximately 0.001 to 0.004 inches, more preferably 0.002 to 0.003 inches. The bond inhibiting layer is preferably made of a fluoropolymer, such as FEP (fluorinated ethylene propylene), PVF (Polyvinyl Fluoride), ETFE (Ethylene Tetrafluoroethylene), PCTFE (PolyChloro TriFluoroEthylene), or PTFE/Teflon® (Polytetraflouroethylene), and/or another material, such as PMP (Polymethylpentene), Nylon (polyamide), or Cellophane. Other ISCZs, such as a friction joint, a sliding joint, or an elastomeric joint, may be used as an alternative to the bond inhibiting layer 30. The bond inhibiting layer 30, or other ISCZ, may be located at the radial midpoint of the barrel 14, such that each barrel wall 22, 24 has approximately the same radial thickness, or it may be located elsewhere in the barrel 14. Thus, the bond-inhibiting layer 30 is shown at the approximate radial midpoint of the barrel 14 by way of example only.

If the barrel 14 includes three or more walls, a bond-inhibiting layer 30 or other ISCZ is preferably located between each of the barrel walls, to increase barrel deflection. Thus, a three-wall barrel preferably includes two bond-inhibiting layers 30 or other ISCZs, a four-wall barrel preferably includes three bond-inhibiting layers 30 or other ISCZs, etc. Alternatively, bond-inhibiting layers 30 or ISCZs may be located between selected barrel walls only. For ease of description, a two-wall barrel 14 will be discussed herein, but any other number of barrel walls may be employed in the ball bat 10.

Figure 3:
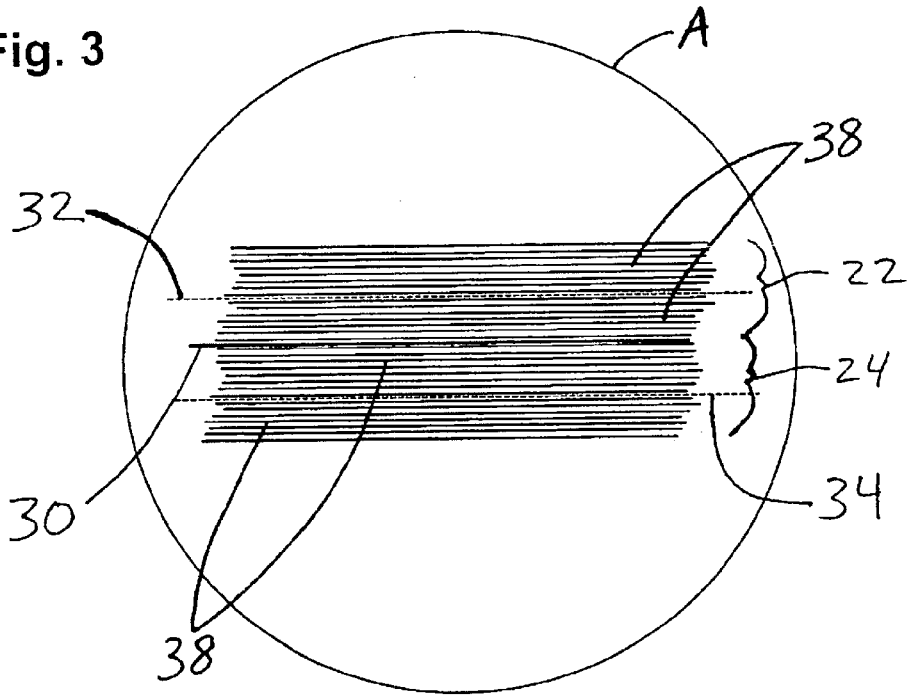
FIG. 3 is a close up sectional view of Section A of FIG. 1.

In the embodiment illustrated in FIGS. 2 and 3, the outer barrel wall 22 and the inner barrel wall 24 each include a plurality of composite plies 38. The composite materials used are preferably fiber-reinforced, and may include glass, graphite, boron, carbon, aramid, ceramic, kevlar, and/or any other suitable reinforcement material, preferably in epoxy form. Each composite ply preferably has a thickness of approximately 0.003 to 0.008 inches, more preferably 0.005 to 0.006 inches. The overall radial thickness of each barrel wall 22, 24 (including barrel portions on both sides of the central axis of the bat) is preferably approximately 0.060 inches to 0.100 inches, more preferably 0.075 to 0.090 inches. Optimal selection and placement of the specific composite materials employed in the ball bat 10 is described in detail below.

The radial location of the neutral axis in each wall varies according to the distribution of the composite layers, and the stiffness of the specific layers. Only the radial components of stress are considered herein, due to their high relative magnitude in comparison to the axial stresses present. If a barrel wall is made up of homogeneous isotropoic layers, the neutral axis will be located at the midpoint of the wall. If more than one composite material is used in a wall, and/or if the material is not uniformly distributed; the neutral axis may reside at a differential radial location. Thus, the first and second neutral axes 32, 34 are shown at the approximate radial midpoints of their respective walls 22, 24 by way of example only.

Figure 4:
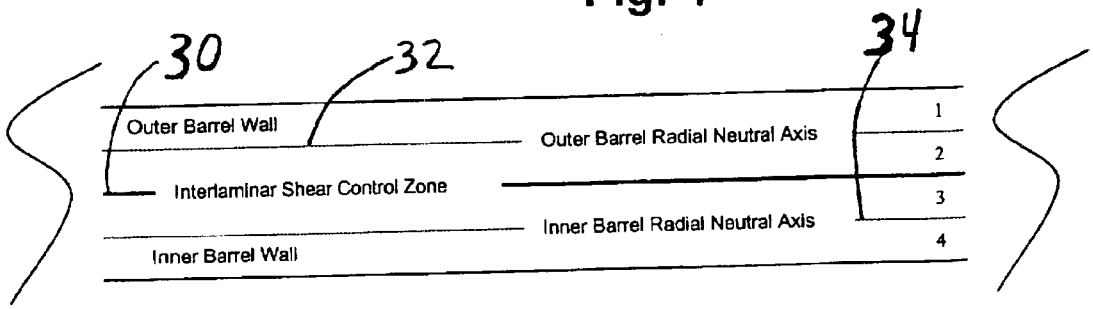
FIG. 4 is a diagrammatic view of the barrel cross section illustrated in FIG. 3.

As illustrated in the diagram of FIG. 4, a double-wall barrel structure may be broken down into four zones, numbered 1, 2, 3, and 4. Zones 1 and 3 are the outer and inner barrel wall compressive stress regions, as they are located above, or radially outwardly from (i.e., on the impact side of), their respective neutral axes. Zones 2 and 4 are the outer and inner barrel wall tensile stress regions, as they are located below, or radially inwardly from (i.e., on the non-impact side of), their respective neutral axes.

Materials in compressive zones 1 and 3 are used primarily to increase the durability of the barrel 14. Materials in tensile zones 2 and 4 are used primarily to increase the stiffness of the barrel 14, and to substantially match the fundamental frequencies of the outer and inner barrel walls 22, 24 to minimize energy losses in the barrel 14. The fundamental frequency of each barrel wall 22, 24 preferably falls within a constructive coupling range between the walls 22, 24, such that minimal losses are encountered during the energy transfer from the outer barrel wall 22 to the inner barrel wall 24. In a preferred embodiment, the fundamental hoop frequency (i.e., the vibration measured around the diameter of the barrel wall) of the outer barrel wall 22 is within 20%, more preferably 10%, of the fundamental hoop frequency of the inner barrel wall 24. The fundametal hoop frequency of each of the outer and inner walls 22, 24 is preferably in the range of 900 to 2000 Hz, more preferably 1000 to 1200 Hz.

Various properties of several common structural composite materials are listed in Table 1 of FIG. 5. High specific energy storage compression materials are best suited to zones 1 and 3, while high stiffness (i.e., high tensile modulus) materials are best suited to zones 2 and 4. The composite materials used in zones 1 and 3 define the resultant durability of the structure, while the composite materials used in zones 2 and 4 adjust the stiffness of the barrel for maximum coupling of energy transfer between the outer and inner walls 22, 24. Accordingly, by placing specific materials in specific zones, the performance and durability of the structure can be modified independently of one another.

In a preferred embodiment, structural (S) glass-reinforced epoxy resin, or S-glass epoxy, is used predominantly in zones 1 and 3, due to its extremely high specific energy storage in compression (approximately 2230 psi). Boron-reinforced epoxy resin, or boron epoxy, which has a specific energy storage in compression of approximately 2220 psi, may additionally or alternatively be used in zones 1 and 3. Other materials having a high specific energy storage in compression may additionally or alternatively be used in zones 1 and 3. Preferably, the materials used in zones 1 and 3 have a specific energy storage in compression of at least 2000 psi, and more preferably, 2200 to 2400 psi. The material(s) used in zone 1 may be the same, or may differ, from those used in zone 3.

S-glass epoxy may also be utilized in zones 2 and 4, due to its high tensile specific energy storage (approximately 4790 psi). Indeed, from a durability standpoint, the entire barrel would benefit from a 100% S-glass multi-wall structure. S-glass epoxy, however, has a relatively low stiffness, or tensile modulus (approximately 6.91 million psi). Thus, if S-glass epoxy were used predominantly in zones 2 and 4, barrel performance would suffer due to a lack of barrel stiffness and poor energy coupling between the barrel walls 22, 24. Accordingly, graphite-reinforced epoxy resin, or graphite epoxy, which has a stiffness or tensile modulus of approximately 20 million psi, is preferably predominantly used in zones 2 and 4, for adjusting the stiffness of the barrel. A limited amount of S-glass epoxy may also be used in zones 2 and 4, however.

Boron epoxy, which has a stiffness or tensile modulus of approximately 29.6 million psi, may additionally or alternatively be used in zones 2 and 4. Graphite epoxy is preferred over boron epoxy, however, because the tensile specific energy storage of graphite epoxy (approximately 1380 psi) is much greater than the tensile specific energy storage of boron epoxy (approximately 565 psi).

Other materials having a high stiffness or tensile modulus, preferably in conjunction with a relatively high tensile specific energy storage, may additionally or alternatively be used in zones 2 and 4. Preferably, the materials used in zones 2 and 4 have a stiffness or tensile modulus of at least 18 million psi, and more preferably 20 to 30 million psi. The materials used in zones 2 and 4 also preferably have a tensile specific energy storage of at least 1000 psi, although the stiffness of the material, which dictates bat performance, is the more significant variable. The material(s) used in zone 2 may be the same, or may differ, from those used in zone 4.

The layers of selected composite materials may be oriented at various angles relative to their respective neutral axes 32, 34 to further modify or enhance barrel performance and durability, and to better match the fundamental frequencies of the outer and inner barrel walls 22, 24. In a preferred embodiment, each of the composite plies 38 in zones 1 and 3 is oriented at approximately 50 to 70° relative to their respective neutral axes 32, 34. Each of the composite plies 38 in zones 2 and 4 is preferably oriented at approximately 20 to 50° relative to their respective neutral axes 32, 34. Each ply within a zone may be oriented at the same or different angles than other plies in that zone. Thus, the location and orientation of specific structural layers with respect to the neutral axes allows the barrel durability to be enhanced, while minimizing strain energy losses in the barrel.

The idea of locating graphite epoxy in the tensile zones (zones 2 and 4) was not initially intuitive. Previous barrel designs, having graphite epoxy predominantly located in zones 1 and 3, were subjected to durability tests. When the tests were concluded, no graphite epoxy fiber failure was witnessed in the compressive zones (zones 1 and 3) of the barrel. Accordingly, there was no motivation to move the graphite fibers into the tensile zones, since compressive failure did not appear to occur in the graphite epoxy fibers.

The graphite epoxy was moved to the tensile zones in the design of a sample bat according to one embodiment of the present invention, and S-glass epoxy was used predominantly in the compressive zones. Durability tests were then performed on the bat, and it was surprisingly discovered that durability increased by a factor of three (e.g., from approximately 150 ball hits until failure, to approximately 450 ball hits until failure) over the previous designs.

Thus, while initial analysis did not indicate compressive failure of the graphite epoxy fibers in the previous bat designs, it is likely that unseen graphite fiber failure was actually occurring in the compressive zones. In other words, the discovery of a dramatic increase in bat durability, resulting from moving graphite epoxy fibers to the tensile zones of the bat barrel, and using S-glass epoxy in the compressive zones of the bat barrel, was unexpected, since analysis did not indicate that compressive fiber failure was occurring in samples constructed following previous designs.

The bat 10 is generally constructed by rolling the various layers of the bat 10 onto a mandrel or similar structure having the desired bat shape. The ends of the layers are preferably "clocked" or offset from one another so that they do not all end in the same location before curing. Accordingly, when heat and pressure are applied to cure the bat 10, the various barrel layers blend together into a distinctive "one-piece" multi-wall construction. Put another way, all of the layers of the bat are "co-cured" in a single step, and blend or terminate together at at least one end, resulting in a single-piece multi-wall structure with no gaps (at the at least one end), such that the barrel 14 is not made up of a series of tubes, each with a wall thickness that terminates at the ends of the tubes. As a result, all of the layers act in unison under loading conditions, such as during striking of a ball.

The blending of the layers into a single-piece multi-wall construction, like tying the ends of a leaf spring together, offers an extremely durable assembly, particularly when impact occurs at the extreme ends of the layer separation zones. By blending the multiple layers together, the barrel 14 acts as a unitized structure where no single layer works independently of the other layers. One or both ends of the barrel 14 may terminate together in this manner to form the one-piece barrel.

In a preferred embodiment, the bat 10 is constructed as follows. First, the various layers of the bat 10 are pre-cut and pre-shaped with conventional machinery. Composite plies 38 used to form the inner wall tensile zone, such as graphite epoxy, and/or other suitable materials, are rolled onto the bat-shaped mandrel. Composite plies 38 used to form the inner wall compressive zone, such as S-glass epoxy, and/or other suitable materials, are then rolled onto the plies 38 of the inner wall tensile zone.

A bond-inhibiting layer 30, or other ISCZ layer or material, may then be rolled onto the plies 38 of the inner wall compressive zone, if such a layer is desired. Next, composite plies 38 used to form the outer wall tensile zone, such as graphite epoxy, and/or other suitable materials, are rolled onto the bond-inhibiting layer 30, or onto the plies 38 of the inner wall compressive section if a bond-inhibiting layer 30 is not employed. Composite plies 38 used to form the outer wall compressive zone, such as S-glass epoxy, and/or other suitable materials, are then rolled onto the plies 38 of the outer wall tensile zone.

As described above, the composite plies 38 are preferably rolled onto the mandrel such that their ends are offset from another, so that they do not all end in the same location before curing. Once all of the layers are arranged, heat and pressure are applied to the layers to cure the bat 10 into a one-piece multi-wall barreled structure, in which the ends of the layers all terminate together such that there are no gaps between the barrel walls and the ISCZ. The layers may be arranged to terminate in this manner at one or both ends of the barrel 14.

The described bat construction, and method of making the same, provides a bat having excellent "trampoline effect"

and durability. These results are primarily due to the selection and placement of specific materials relative to the neutral axes in the outer and inner barrel walls 22, 24. Specifically, locating materials having a high specific energy storage in compression above the neutral axes, and materials with a high stiffness or tensile modulus below the neutral axes, yields a durable high performance ball bat. Additionally, the blending of barrel layers in a single curing step provides for increased durability, especially during impact at the extreme ends of the barrel layers.

Thus, while several embodiments have been shown and described, various changes and substitutions may of course be made, without departing from the spirit and scope of the invention. The invention, therefore, should not be limited, except by the following claims and their equivalents.

What is claimed is:

1. A ball bat including a barrel, a handle, and a tapered section joining the barrel to the handle, with the barrel comprising:

a substantially cylindrical outer wall including a first material located radially outwardly from a neutral axis of the outer wall, and a second material located radially inwardly from the neutral axis of the outer wall;

a substantially cylindrical inner wall separated from the outer wall by an interface shear control zone, the inner wall including a third material located radially outwardly from a neutral axis of the inner wall, and a fourth material located radially inwardly from the neutral axis of the inner wall;

wherein the first and third materials each have a specific energy storage in compression of at least 2000 psi, and the second and fourth materials each have a tensile modulus of at least 18 million psi.

2. The ball bat of claim 1 wherein the first and third materials each have a specific energy storage in compression of 2200 to 2400 psi.

3. The ball bat of claim 1 wherein the second and fourth materials each have a tensile modulus of 20 to 30 million psi.

4. The ball bat of claim 1 wherein the second and fourth materials each have a tensile specific energy storage of at least 1000 psi.

5. The ball bat of claim 1 wherein at least one of the first, second, third, and fourth materials comprises a fiber-reinforced resin composite material.

6. The ball bat of claim 5 wherein the composite material includes at least one material selected from the group consisting of glass, graphite, boron, carbon, aramid, and ceramic.

7. The ball bat of claim 1 wherein the first and third materials each comprise a structural glass-reinforced epoxy resin.

8. The ball bat of claim 1 wherein the second and fourth materials each comprise a graphite-reinforced epoxy resin.

9. The ball bat of claim 1 wherein at least one of the first, second, third, and fourth materials comprises a boron-reinforced epoxy resin.

10. The ball bat of claim 1 wherein the interface shear control zone comprises a layer of a bond inhibiting material separating the outer wall from the inner wall.

11. The ball bat of claim 10 wherein the bond inhibiting material comprises at least one material selected from the group consisting of a Teflon®, polymethylpentene, polyvinyl fluoride, a nylon, and cellophane.

12. The ball bat of claim 10 wherein the outer wall, the inner wall, and the layer of bond inhibiting material all terminate together at at least one end of the barrel.

13. The ball bat of claim 1 wherein the interface shear control zone comprises at least one of a friction joint, a sliding joint, and an elastomeric joint.

14. The ball bat of claim 1 wherein a fundamental hoop frequency of the outer wall is within 20% of a fundamental hoop frequency of the inner wall.

15. The ball bat of claim 14 wherein the fundamental hoop frequencies of the outer and inner walls are each in a range of 1000 to 1200 Hz.

16. A ball bat including a barrel, a handle, and a tapered section joining the barrel to the handle, with the barrel comprising:

a substantially cylindrical outer wall; and a substantially cylindrical inner wall located within the outer wall, wherein the outer wall and the inner wall blend together at at least one end of the barrel;

an interface shear control zone separating the outer wall from the inner wall, such that the outer wall is divided into a first outer section and a first inner section by a first neutral axis, and the inner wall is divided into a second outer section and a second inner section by a second neutral axis;

wherein the first and second outer sections each include a material having a specific energy storage in compression of at least 2000 psi, and the first and second inner sections each include a material having a stiffness of at least 18 million psi.

17. A ball bat including a barrel, a handle, and a tapered section joining the barrel to the handle, with the barrel comprising:

a substantially cylindrical first wall including a first material located radially outwardly from a neutral axis of the first wall, and a second material located radially inwardly from the neutral axis of the first wall, wherein the first material has a specific energy storage in compression of at least 2000 psi, and the second material has a tensile modulus of at least 18 million psi;

a substantially cylindrical second wall located within the first wall;

a first interface shear control zone separating the first wall from the second wall;

a substantially cylindrical third wall located within the second wall; and a second interface shear control zone separating the second wall from the third wall.

* * * * *